US011980312B1

(12) United States Patent
Duong

(10) Patent No.: US 11,980,312 B1
(45) **Date of Patent: *May 14, 2024**

(54) CERVICAL MULTI-POSITION PILLOW

(71) Applicant: Johnathan Duong, Lake Forest, CA (US)

(72) Inventor: Johnathan Duong, Lake Forest, CA (US)

( * ) Notice: Subject to any disclaimer, the term of this patent is extended or adjusted under 35 U.S.C. 154(b) by 73 days.

This patent is subject to a terminal disclaimer.

(21) Appl. No.: 17/644,057

(22) Filed: Dec. 13, 2021

Related U.S. Application Data

(63) Continuation-in-part of application No. 17/085,085, filed on Oct. 30, 2020, now Pat. No. 11,583,116.

(60) Provisional application No. 62/927,844, filed on Oct. 30, 2019.

(51) Int. Cl.
*A47G 9/10* (2006.01)

(52) U.S. Cl.
CPC .... *A47G 9/1081* (2013.01); *A47G 2009/1018* (2013.01)

(58) Field of Classification Search
CPC ..... A47G 9/0253; A47G 9/10; A47G 9/1054; A47G 9/1072; A47G 9/1081; A47G 2009/1018
See application file for complete search history.

(56) References Cited

U.S. PATENT DOCUMENTS 4,754,513 A * 7/1988 Rinz ..... A47G 9/0253 5/636
4,829,614 A * 5/1989 Harper ..... A47G 9/1081 5/636
5,884,351 A * 3/1999 Tonino ..... A47G 9/1081 5/636
6,321,402 B1 * 11/2001 Ming-Chung ..... A47G 9/10 5/639
6,490,743 B1 * 12/2002 Adat ..... A47G 9/10 5/490
7,203,983 B1 * 4/2007 Reeves ..... A47G 9/109 5/639
7,578,014 B1 * 8/2009 Rodriguez ..... A47G 9/0253 5/639
7,987,537 B1 * 8/2011 Hsiao ..... A47G 9/1081 5/636
8,726,436 B2 * 5/2014 Wright ..... A47G 9/1081 5/636

(Continued)

*Primary Examiner* — Justin C Mikowski
*Assistant Examiner* — George Sun
(74) *Attorney, Agent, or Firm* — CIONCA IP Law P.C.

(57) ABSTRACT

A multi-position pillow for providing cervical area support during sleep, the multi-position pillow comprising: an outer cover adapted to be opened; a core support removably associated with the outer cover, the core support comprising a sloped body with a contour hole and venting through holes, wherein a downward slope of the sloped body extends from a first end to a second end, a head connected to the first end and having a hump, and a ledge disposed in the head along a top end of the hump; and a contouring material layer removably associated with the outer cover and compressed over a top of the core support; wherein an association of the outer cover with the core support and the contouring material layer causes the core support and the contouring material layer to be positioned centrally within the outer cover, such that to provide cervical area support to a user.

18 Claims, 8 Drawing Sheets

(56) References Cited

U.S. PATENT DOCUMENTS 9,226,605 B1* 1/2016 Castellano ..... A47G 9/0253
D758,100 S 6/2016 Pham
10,213,355 B2* 2/2019 Marinkovic ..... A47G 9/1081
10,561,259 B1* 2/2020 Gaspari ..... A47G 9/109
10,582,783 B1* 3/2020 Hill ..... A47G 9/04
10,905,265 B1* 2/2021 Warner ..... A47G 9/007
2002/0138907 A1* 10/2002 Wang ..... A47G 9/10 5/636
2005/0172410 A1* 8/2005 Huang ..... A47G 9/0246 5/636
2005/0177941 A1* 8/2005 Miller ..... A47G 9/0253 5/490
2007/0245493 A1* 10/2007 Leifermann ..... A47G 9/0253 5/636
2010/0077551 A1* 4/2010 Liu ..... A47G 9/10 5/636
2012/0255126 A1* 10/2012 Abdo ..... A47G 9/109 5/636
2012/0272453 A1* 11/2012 Jaskot ..... A47G 9/10 5/644
2012/0278992 A1* 11/2012 Ou ..... A47G 9/0253 5/638
2014/0317852 A1* 10/2014 Chen ..... A47G 9/109 5/644
2017/0156958 A1* 6/2017 Roh ..... A47G 9/109
2018/0064253 A1* 3/2018 DeMore ..... A47G 9/10
2018/0192799 A1* 7/2018 Fulkerson ..... A47G 9/1081
2018/0199738 A1* 7/2018 Klein ..... A47G 9/10
2018/0325291 A1* 11/2018 Holbrook ..... A47G 9/10
2019/0008293 A1* 1/2019 Bergman ..... A47G 9/0253
2019/0133349 A1* 5/2019 Fux ..... A47G 9/10
2019/0191895 A1* 6/2019 Shek ..... A47G 9/007
2019/0298088 A1* 10/2019 Li ..... A47G 9/10
2019/0320828 A1* 10/2019 Berney ..... A47G 9/0253
2020/0022510 A1* 1/2020 Shokrian ..... A47G 9/0253
2020/0093297 A1* 3/2020 Dennewald ..... A47G 9/10
2021/0298499 A1* 9/2021 Kim ..... A61F 7/02
2022/0015547 A1* 1/2022 Hung ..... A47C 7/383

* cited by examiner

CERVICAL MULTI-POSITION PILLOW

CROSS-REFERENCE TO RELATED APPLICATIONS

This application is a continuation-in-part of U.S. Non-Provisional application Ser. No. 17/085,085, filed Oct. 30, 2020, which claims the benefit of U.S. Provisional Application No. 62/927,844, filed Oct. 30, 2019, both of which are hereby incorporated by reference, to the extent that they are not conflicting with the present application.

BACKGROUND OF INVENTION

1. Field of the Invention

The invention relates generally to apparatuses for providing cervical area support during sleep and more specifically to pillows that provide direct cervical area support during sleep.

2. Description of the Related Art

As is known, sleep is a vital and necessary naturally recurring state of mind and body, wherein the body's systems operate in an anabolic state to help restore and maintain mood, memory, and cognitive function. The lack or disruption of sleep may inhibit this restorative process, and the particular pillow a user sleeps on plays an important role in the quality of sleep the user experiences.

Individuals who sit for extended periods of time (e.g., at a desk, in a car, on a plane) may experience lower neck soreness due to the weight of the head sitting on the shoulders at an unnatural angle for such long periods of time. These individuals may experience sleeping problems and may suffer from discomfort due to improper cervical area support during sleep.

Additionally, individuals who sleep in different positions throughout the night and/or have a need to frequently adjust their sleeping position may experience discomfort from improper cervical area support. Furthermore, an individual who sleeps on their arm while sleeping on their side may experience numbness in the fingers and arm due to a lack of proper distribution of pressure beneath the arm. The numbness experienced in the fingers and arm may thus cause the user to toss and turn throughout the night in an effort to alleviate such discomfort, which further inhibits the sleep restorative process.

Existing pillows may not provide the proper cervical area support for individuals of varying height, weight, and age since current designs allow for only one height setting. Additionally, existing pillows may be too stiff, which may prevent the user from comfortably moving in their sleep, and essentially locking the user into a single position. Furthermore, existing pillows may alternatively be too soft and may bottom out or flatten during use because of the overall weight of the user's head and/or neck, providing little comfort and/or cervical support during use.

Another shortcoming of existing pillows that may hinder a user's ability to utilize them comfortably is said pillows tendencies to retain heat. Such an issue may result in individuals becoming too warm while sleeping and waking up, or not being able to get to sleep at all, as a result of said pillows becoming too warm during use. Additionally, existing pillows may not be able to contour to a user's head properly, thus making it difficult for said pillows to provide the desired combination of support and comfort to a user's head and neck.

Therefore, there is a need to solve the problems described above by providing a customizable, comfortable, multi-position pillow that supports and provides decompression for the head, neck, and shoulders and can accommodate individuals of varying height, weight, and age whom possess particular sleeping preferences and styles.

The aspects or the problems and the associated solutions presented in this section could be or could have been pursued; they are not necessarily approaches that have been previously conceived or pursued. Therefore, unless otherwise indicated, it should not be assumed that any of the approaches presented in this section qualify as prior art merely by virtue of their presence in this section of the application.

BRIEF INVENTION SUMMARY

This Summary is provided to introduce a selection of concepts in a simplified form that are further described below in the Detailed Description.

In an aspect, a multi-position pillow for providing cervical area support and decompression during sleep is provided. The multi-position pillow may comprise: an outer cover adapted to be selectively opened; a core support removably associated with the outer cover, the core support comprising: a sloped body having a first end and a second end, wherein a downward slope of the sloped body extends from the first end to the second end; a plurality of venting through holes in the sloped body; a contour hole on a center portion of the sloped body; a head connected to the first end, the head comprising a hump; and a first recess disposed along a top end of the hump, the first recess forming a rounded ledge at an end of the head; wherein the plurality of venting through holes and the contour hole are configured to improve pillow ventilation by allowing air to travel through the core support; and a contouring material layer being removably associated with the outer cover, the contouring material layer being compressed over a top surface of the core support when disposed within the outer cover; wherein the compression of the contouring material layer over a top surface of the core support allows the contouring material layer to lay over the contour hole to achieve an improved contour for supporting a user's head; and wherein, thereby, when a user is positioned atop the contouring material layer and the core support during sleep, such that user's neck rests on the hump, cervical area support is provided, and further a tension force is induced on the user's neck, the tension force causing a decompression of the neck and thus, resulting in a relief of pressure in the cervical area. Thus, an advantage is that the pillow may accommodate users of various heights, weights, and ages who sleep in various positions. Another advantage is that the soft, breathable pillow sock cover may provide cervical and/or facial area support and comfort for the user. Another advantage is that the pillow core support may evenly distribute the weight of a user's head during sleep, allowing the user to achieve maximum muscle relaxation and pressure relief. An additional advantage is that, because the pillow core support is designed for preventing a flattening out, the multi-position pillow may provide continuously elevated cervical area support during use. Another advantage is that the utilization of venting through holes on the core support may allow heat held by said core support to be released more effectively, while simultaneously increasing the flexibility of the core support, further allowing it to conform to the contours of a user's head. Another advantage is that the utilization of a contour hole on the core support may allow said core support to be utilized alongside the contouring material layer to better conform to the contours of a user's head during use, while also providing additional ventilation to said core support, and thus the multi-position pillow itself.

In another aspect, a multi-position pillow for providing cervical area support and decompression during sleep is provided. The multi-position pillow may comprise: an outer cover adapted to be selectively opened; and a core support removably associated with the outer cover, the core support comprising: a sloped body having a first end and a second end, wherein a downward slope of the sloped body extends from the first end to the second end, the sloped body being adapted to selectively receive and provide support for a user's neck and head; a plurality of venting through holes in the sloped body; a contour hole on a center portion of the sloped body; a head connected to the first end, the head comprising a hump; and a first recess disposed along a top end of the hump, the first recess forming a rounded ledge at an end of the head; wherein the plurality of venting through holes is configured to improve pillow ventilation by allowing air to travel through the core support; and wherein the contour hole is configured to allow the core support to conform to the contours of user's head while allowing air to travel through the core support to further improve pillow ventilation; wherein the core support is configured to provide cervical area support to a user during sleep. Thus, an advantage is that the core support may allow for a more even distribution of weight for the cervical area, while also relieving pressure points in the shoulder caps and on the back of the skull. Another advantage is that the pillow core support may evenly distribute the weight of a user's head during sleep, allowing the user to achieve maximum muscle relaxation and pressure relief. Another advantage is, due to an even distribution of weight, the reduction in numbness experienced in the user's fingers and arms, which may occur as a result of undistributed pressure accumulated while sleeping on one's side. Another advantage is that the utilization of venting through holes on the core support may allow heat held by said core support to be released more effectively, while simultaneously increasing the flexibility of the core support, further allowing it to conform to the contours of a user's head. Another advantage is that the utilization of a contour hole on the core support may allow said core support to better conform to the contours of a user's head during use, while also providing additional ventilation to said core support, and thus the multi-position pillow itself.

In another aspect, a method of obtaining direct cervical area support using a multi-position pillow is provided. The method may comprise the steps of: receiving the multi-position pillow, the multi-position pillow comprising: an outer cover adapted to be selectively opened; and a core support removably associated with the outer cover, the core support comprising: a sloped body having a first end and a second end, wherein a downward slope of the sloped body extends from the first end to the second end, the sloped body being adapted to selectively receive and provide support for a user's neck and head; a plurality of venting through holes in the sloped body; a contour hole on a center portion of the sloped body; a head connected to the first end, the head comprising a hump, the hump being adapted to selectively receive and provide support for a user's head; and a recess disposed along a top end of the hump, the recess forming a rounded ledge at an end of the head; placing the multi-position pillow onto a surface, such that a face of the hump of the pillow core support is oriented to face up; and laying on a top of the multi-position pillow, such that to obtain cervical area support, the multi-position pillow providing the cervical area support at a user-selected sleeping elevation. Thus, an advantage may be the accommodation of users of varying weight, height and age who may possess cervical soreness and/or related issues, and who may prefer to sleep in specific positions (e.g., back sleepers, stomach sleepers, side sleepers). Another advantage is the accommodation of users who prefer to sleep closer to the surface of the bed, such that cervical area comfort and support are provided, without the overexertion of neck support. An additional advantage is the accommodation of a user who suffers from sinus issues and/or minor reflux issues and who may thus benefit from sleeping elevated at a higher position. Another advantage is the accommodation of users who sleep warmer and who may benefit from a pillow capable of releasing stored heat more effectively through the use of the venting through holes and the contour hole. Another advantage is the accommodation of users who prefer different amounts support and contouring from a pillow to adapt to the shape of their head, through the selective utilization of the provided contour hole.

The above aspects or examples and advantages, as well as other aspects or examples and advantages, will become apparent from the ensuing description and accompanying drawings.

BRIEF DESCRIPTION OF THE DRAWINGS

For exemplification purposes, and not for limitation purposes, aspects, embodiments or examples of the invention are illustrated in the figures of the accompanying drawings, in which.

DETAILED DESCRIPTION

Figure 1:
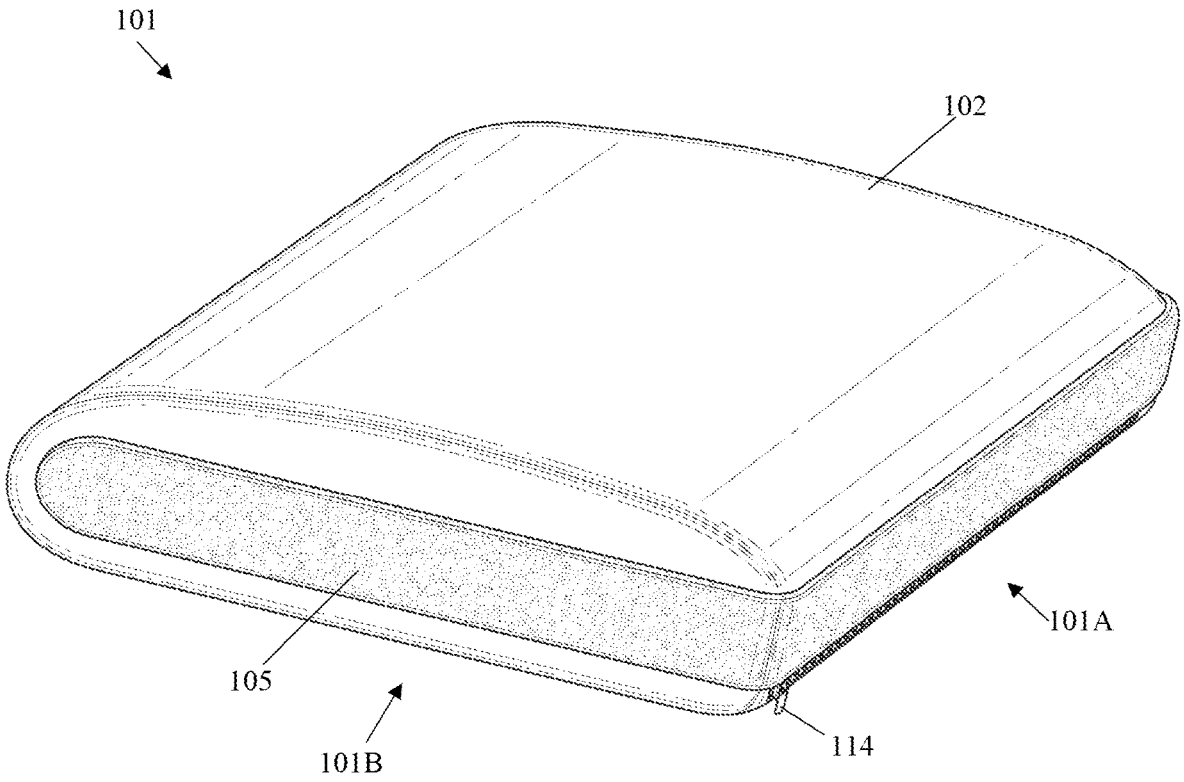
FIG. 1 illustrates a side perspective view of a cervical multi-position pillow, according to several aspects.

What follows is a description of various aspects, embodiments and/or examples in which the invention may be practiced. Reference will be made to the attached drawings, and the information included in the drawings is part of this detailed description. The aspects, embodiments and/or examples described herein are presented for exemplification purposes, and not for limitation purposes. It should be understood that structural and/or logical modifications could be made by someone of ordinary skills in the art without departing from the scope of the invention.

It should be understood that, for clarity of the drawings and of the specification, some or all details about some structural components or steps that are known in the art are not shown or described if they are not necessary for the invention to be understood by one of ordinary skills in the art.

For the following description, it can be assumed that most correspondingly labeled elements across the figures (e.g., 209 and 309, etc.) possess the same characteristics and are subject to the same structure and function. If there is a difference between correspondingly labeled elements that is not pointed out, and this difference results in a non-corresponding structure or function of an element for a particular embodiment, example or aspect, then the conflicting description given for that particular embodiment, example or aspect shall govern.

FIG. 1 illustrates a side perspective view of a cervical multi-position pillow 101, according to several aspects. As shown, the cervical multi-position pillow ("cervical multi-position pillow," "multi-position pillow," "pillow") 101 may be provided with an outer pillow sock cover ("outer pillow sock cover," "pillow sock cover," "outer cover") 102, as an example. The multi-position pillow 101 may also be provided with an inner pillow core support (not shown), which will be discussed in greater detail later, that is positioned within the pillow sock cover 102 to provide maximal cervical area support for the user. The multi-position pillow 101 may also be provided with a contouring adjustment material layer (not shown), which will be discussed in greater detail when referring to FIG. 5, that functions as stuffing within the outer pillow sock cover 102, as an example. As will be discussed in further detail herein below, the pillow sock cover 102 and the pillow core support (not shown) may be used in tandem with or separately from the contouring adjustment material layer (not shown) to provide varying levels of cervical area support, as desired by the user, such that the multi-position pillow 101 is thus customizable.

As shown in FIG. 1, the multi-position pillow 101 may comprise a middle region ("middle region," "central region") 105, which may be a gusset, for example, disposed centrally along the pillow 101, such that the middle region 105 is integral to the sock cover 102, as an example. As shown as an example, the middle region 105 may line, and protrude slightly outwardly along, the sides 101B and the front 101A of the pillow 101. As an example, the front 101A of the pillow 101 may be provided with a zipper 114 lining a bottom of the middle region 105, as shown. As will be discussed later, the middle region 105 and the pillow sock cover 102 may be manufactured from soft, silky material such that to maintain a coolness throughout the pillow surface, as an example.

Figure 2A:
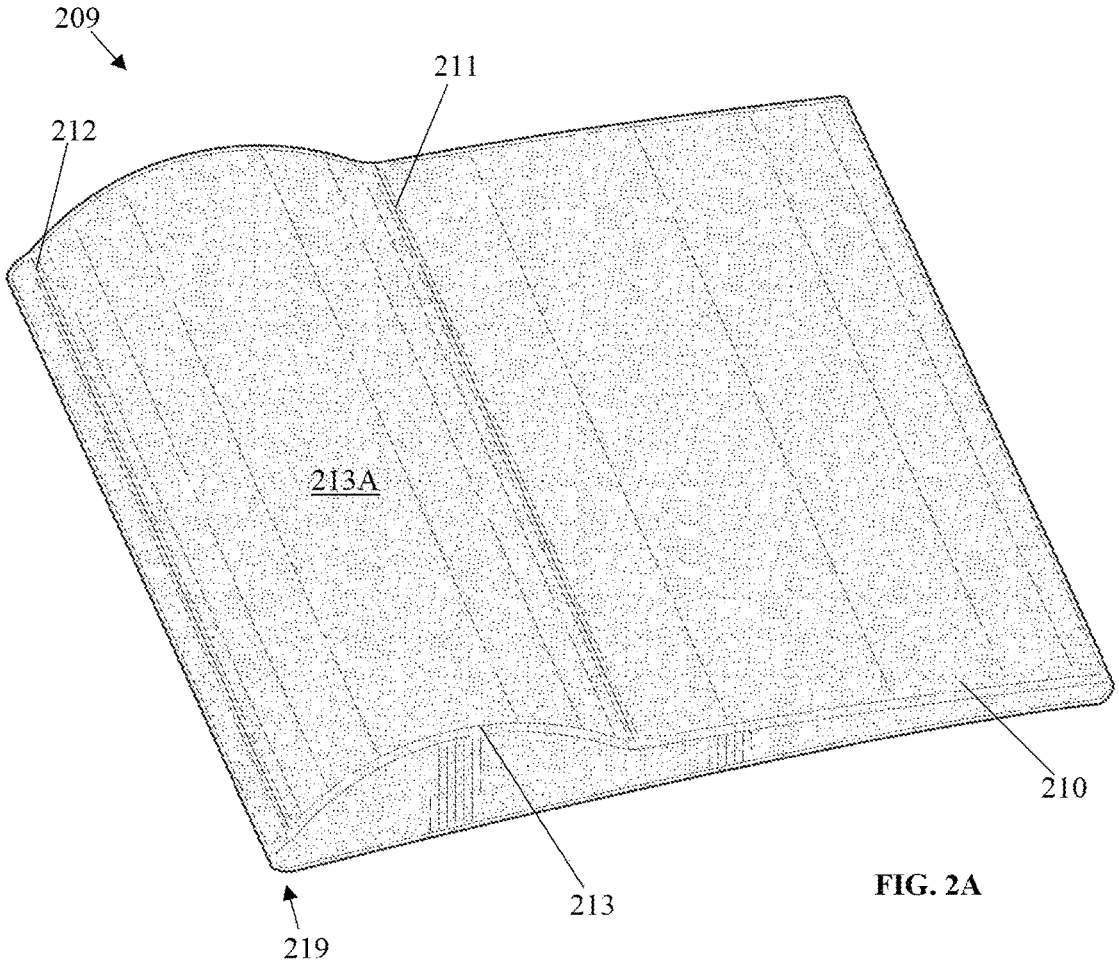
FIGS. 2A-2B illustrate a top perspective view and side elevation view, respectively, of a pillow core support, according to several aspects.
Figure 2B:
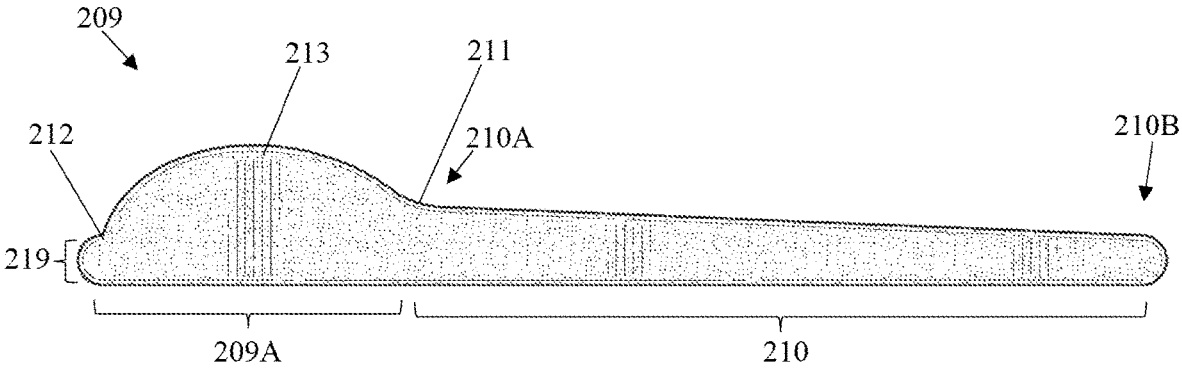

FIGS. 2A-2B illustrate a top perspective view and side elevation view, respectively, of a pillow core support 209, according to several aspects. As mentioned previously above when referring to FIG. 1, the multi-position pillow (e.g., 101) may be provided with the pillow core support ("pillow core support," "core support") 209, which may be disposed centrally within the pillow cover (e.g., 102). As shown in FIGS. 2A-2B, the pillow core support 209 may be provided with a downward-sloping hump design that generally models the natural curvature of a human's shoulders, neck, and lower skull. The design of the core support 209 may provide direct support to the cervical area of the user by evenly distributing the pressure applied by the weight of the user's head, which may be about 10-12 pounds, for example, onto the user's neck and body, which may thus relieve pressure points in the user's shoulder caps and lower skull, as will be described in more detail below. The pillow core support 209 may be manufactured from any suitably durable and soft material, such as polyurethane foam, as an example.

As an example, the complex design of the pillow core support 209 may enable the pillow core support to be used in different positions, depending on the desired level of cervical support (i.e., desired height of the pillow applied below the cervical area). As shown in FIG. 2B, the pillow core support 209 may be provided with a head or head portion 209A connected to a sloped body ("sloped body," "downward-sloping portion," "downward slope," "ramp") 210 having a first end 210A and a second end 210B. As an example, the first end 210A may comprise a height of about 1.25 inches, and the second end 210A may comprise a height of about 0.75 inches, such that a slope of the downward-sloping portion 210 is thus −0.05 for a body 210 that is about 10 inches long, for example. The downward-sloping portion 210 of the pillow core support 209 may accommodate users who prefer little or no direct neck support during sleep, such as users who prefer to sleep flatter and closer to the surface of the bed, as an example. The downward-sloping portion 210 may thus constitute the lowest setting of use and may enable users who prefer to sleep on their stomach, back and/or side, for example, to rest without direct neck support while still maintaining comfort. Thus, an advantage is the accommodation of users who prefer to sleep closer to the surface of the bed, such that cervical area comfort and support are provided, without the overexertion of neck support.

Alternatively, the pillow core support 209 may provide support and comfort for users who prefer more direct cervical support, particularly support for the user's neck and lower skull area, for example. The pillow core support 209 may be provided with a cylindrical hump or bump 213 disposed on the head 209A, as shown, wherein the hump 213 comprises a top end 211 and a bottom end 212. The top end 211 and the bottom end 212 may thus function as supporting top/first and bottom/second recesses, respectively, disposed on either side of the hump 213, as shown as an example. As shown in FIGS. 2A— 2B, the bottom recess 212 may form a rounded ledge 219 in the head 209A that protrudes outwardly and extends a length below the hump 213. As will be discussed in greater detail below, the rounded ledge 219 may provide an additional surface on which a user may rest a portion of their body (e.g., the shoulder tops) Additionally, the ledge 219 may be rounded, as shown, such that to provide a more smooth surface on which the user may rest, as an example. As shown in FIG. 2A, the pillow core support may comprise a face 213A oriented to face upwardly when the pillow core support 209 is provided within the outer cover. As shown in FIG. 2B, the top end/recess 211 may occupy a portion of the core support 209 that is higher (in height) than that of the bottom end/recess 212, as an example. As will be described in detail below, the pillow core support 209 shown in FIGS. 2A— 2B may provide support and pressure relief for users who prefer to sleep on their backs or on their sides.

Figure 3:
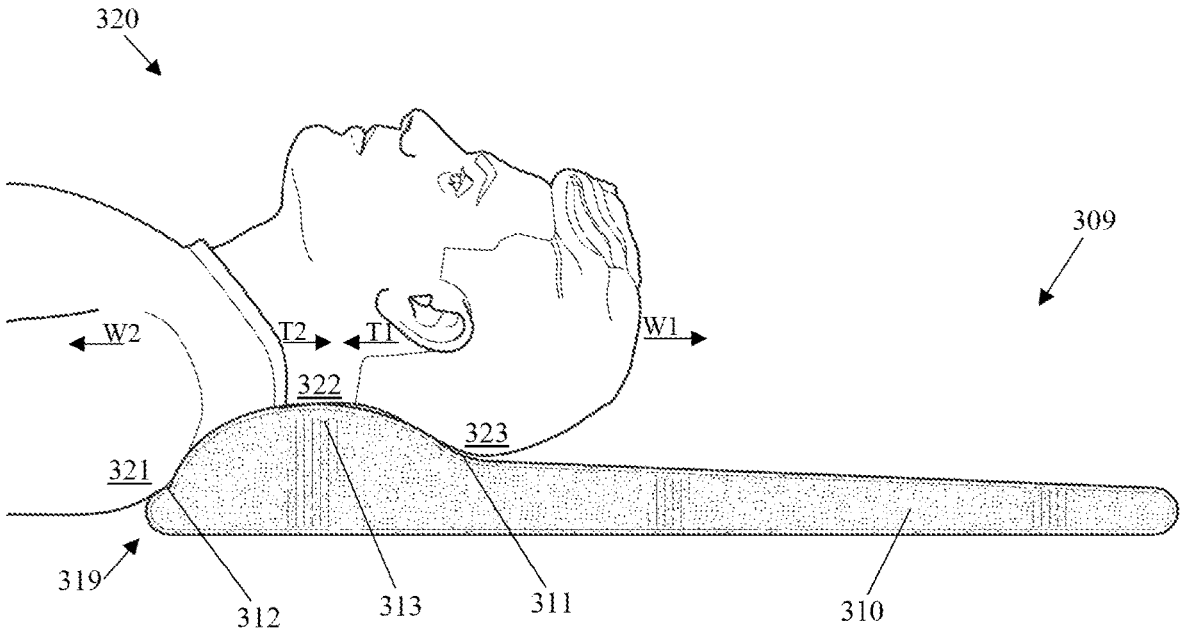
FIG. 3 illustrates a side elevation view of an example of use of a cervical multi-position pillow having a pillow core support, according to an aspect.

FIG. 3 illustrates a side elevation view of an example of use of a cervical multi-position pillow having a pillow core support 309, according to an aspect. It should be noted that the outer cover (e.g., 102 in FIG. 1) surrounding the pillow core support 309 has been omitted from this view for clarity. As mentioned above, the pillow core support 309 may accommodate and provide pressure relief for users who prefer to sleep on their backs.

As an example of use, the multi-position pillow (e.g., 101 in FIG. 1) may be positioned on the bed or some other surface, such that the ramp 310 of the pillow core support 309 within the pillow cover is positioned away from the user (i.e., at a far end of the pillow with respect to the user), and the hump 313 is positioned close to the user, as shown. Then, the user may position their head onto the top recess 311, such that the back of the neck rests on the face (e.g., 213A) of the hump 313 and the tops of the shoulders rest on the rounded ledge 319, as illustrated in FIG. 3, for example. The hump 313 may support and align with the natural curvature of the user's neck and may relieve pressure and/or compression therein, as an example. The rounded ledge 319 may align with the natural curvature of the tops of the shoulder caps, and may thus support and apply pressure to the tops of the shoulders to help relieve pressure in that area, as an example. The top recess 311 may support the base of the user's skull, as an example, and may target pressure points in that area, and may thus disperse the weight of the user's head 323 down through the downward-sloping portion 210, as will be discussed in greater detail below. The extended length (e.g., 10 inches) of the downward-sloping portion 310 may especially allow a more even weight distribution for users with larger heads and/or longer necks, as an example.

As mentioned above, the pillow core support 309, and significantly the hump 313, may relieve pressure and compression in the user's neck, such that the user can experience greater muscle relaxation and therefore better-quality sleep. As shown in FIG. 3, during use, a user 320 may lay on the pillow core support 309, such that the user's head 323 rests on the top recess 311 of the sloped body 310 and the user's neck 322 rests on the hump 313. As discussed previously above, the weight exerted by the user's head 323 onto the shoulders 321 and neck 322 may be distributed away and down through the ramp 310 of the core support 309, such that any built-up pressure is directed away from the shoulders 321 and neck 322. As a simplified example, let a force applied onto the neck 322 by the weight of the head 323 be represented by the vector W1. Similarly, as an example, let a force applied onto the neck 322 by the weight of the torso (collectively, "shoulders" 321) be represented by the vector W2, as shown. The forces W1, W2 exerted onto the neck 322 may be proportional to the force of gravity and the weights of the head 323 and the shoulders 321, respectively, as is known. In comparison with traditional pillows or foam pillows whose designs can cause a compressing of the neck 322 by the respective weights of the head 323 and the shoulders 321, the hump 313 of the pillow core support 309 applies upward pressure onto the back of the neck, as described above, such that the forces W1, W2 exerted by the weights of the head and the shoulders, respectively, pull or stretch apart, rather than compress inward.

Thus, as shown in FIG. 3, the hump 313 induces a net tensioning or tension force T within the neck 322, originating at the opposite ends of the neck at the connection points of the head and the shoulders, for example. The tension forces may be idealized in this scenario, such that the tension T1, T2 carried by the neck are equal and opposite to the forces exerted by the weights of the head and the shoulders, respectively, as shown, such that T1=W1 and T2=W2, for example. As an example, the downward slope of the sloped body 310 may cause the head 323 to be greater inclined (as a ball tending toward rolling down a hill, for example), such that to increase the force W1 (exhibited by the weight of the head), and therefore increase the force W2 (exhibited by the weight of the torso and shoulders 321, which are substantially anchored throughout the night), with respect to the neck 322. As such, since T2, which is effectively unchanging with respect to the neck 322, is opposite T1, the net tension force T carried by the neck may thus be the difference of T1 and T2. The tension force T may thus cause a decompression of the muscles in the neck, which may alleviate pressure and therefore stress, as mentioned above. Thus, the combined design of the hump 313, the top 311 and the bottom 312 recesses, the rounded ledge 319, and the downward sloping body 310 may allow the cervical area to achieve maximal muscle relaxation and pressure relief. Thus, an advantage is that the pillow core support may evenly distribute the weight of a user's head during sleep, allowing the user to achieve maximal muscle relaxation and pressure relief. An additional advantage is that, because the pillow core support is designed for preventing a flattening out, the multi-position pillow may provide continuously elevated cervical area support during use.

As mentioned previously above, the pillow core support 309 may accommodate users who also prefer to sleep on their side. Similar to a user who prefers to sleep on their back, as shown in FIG. 3, a user who sleeps on their side may position their head 323 onto the pillow core support 309, such that the neck 322 rests on the hump 313 and the back of the head 323 rests on the downward slope 310, as an example. The user 320 may then roll onto their side, such that the user's torso rests on top of one of the user's arms, as an example. As the user 320 rests on their side, the user's neck 322 may remain positioned comfortably over the hump 313 and the side of the user's face (depending on the side the user sleeps on) may rest on a portion of the sloped body 310. As similarly described above, while the user sleeps on their side, the hump 313 may continuously support the user's neck 322, such that to apply relieving pressure to the neck 322, and such that the weight from the user's head 323 may be distributed down through the ramp 310. As described above, while the user sleeps on their side, the net tension force T may be induced in the neck 322 by the hump 313, such that the muscles lining the side of the neck carry the tension force T. As such, the tension force T may cause a decompression of the side neck muscles, which may also reduce pressure buildup within the arm (due to the decompression within the neck 322), preventing the undesirable sensation of tingling and numbness within the arms and fingers, for example. Throughout the night, the user may naturally roll onto their back, and then back onto their side, and so on back and forth, as an example. However, due to the positioning of the bump 313 below the user's neck, the pillow core support 309 may continuously supply direct upward support (via the induced tension force) to the cervical area, even as the user moves in their sleep. Thus, due to a more even distribution of weight and the decompression of the neck, an advantage is the reduction in numbness experienced in the user's fingers and arms, which may occur as a result of undistributed pressure accumulated while sleeping on one's side.

Figure 4A:
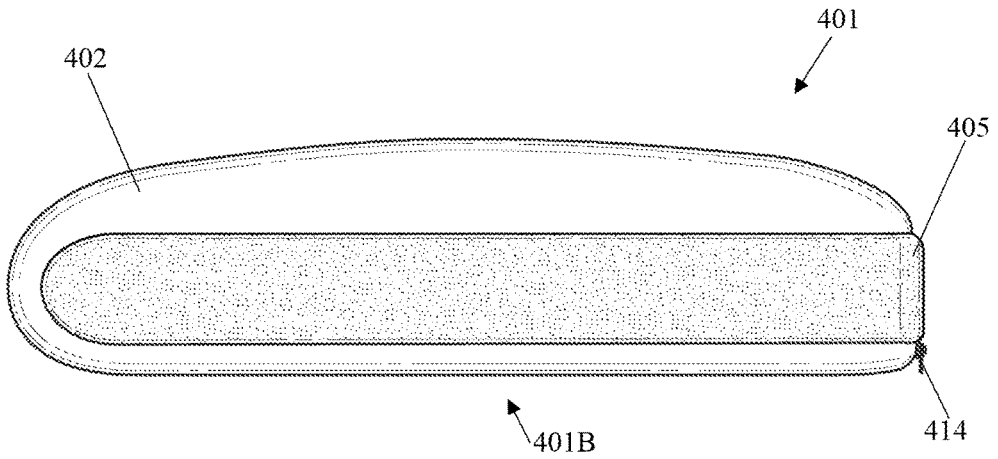
FIGS. 4A-4B illustrate a side elevation view and a front elevation view, respectively, of the cervical multi-position pillow of FIG. 1, according to an aspect.
Figure 4B:
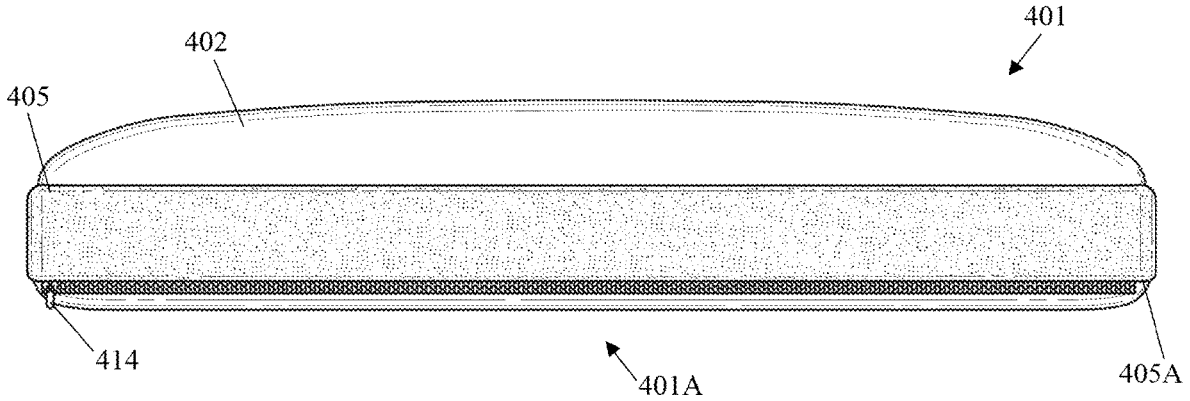

FIGS. 4A-4B illustrate a side elevation view and a front elevation view, respectively, of the cervical multi-position pillow 101 of FIG. 1, according to an aspect. As similarly mentioned above when referring to FIG. 1, the multi-position pillow 401 may be provided with a pillow sock cover 402 and a zipper 414, as shown. As disclosed previously above, the pillow sock cover 402 and the pillow core support (e.g., 209 in FIGS. 2A— 2B) may function in tandem with, or separately from, additional contouring adjustment material to provide varying degrees of cervical support. The embodiment shown in FIGS. 4A-4B illustrates the cervical multi-position pillow 401 comprising only the pillow sock cover 402 and internal core support (not shown) (i.e., without the contouring adjustment material layer). The zipper 414, shown in FIGS. 4A-4B, may enable the insertion and/or removal of the pillow core support and/or the contouring adjustment material into and/or from the pillow sock cover 402. It should be understood that the zipper 414 is depicted slightly larger for clarity.

As shown as an example, the zipper 414 may be disposed along a bottom 405A of a portion of the middle region 405 lining the front 401A of the multi-position pillow 401. As mentioned previously above when referring to FIG. 1, the middle region 405 may protrude slightly outwardly along the sides 401B and front 401A, as shown. As such, the zipper 414 may be tucked/hidden within the bottom 405A of the middle region 405 portion when the zipper 414 is closed, for example, such that the zipper 414 does not unintentionally poke or nick the user during use. As an example, the user may remove the pillow core support (not shown) from the pillow sock cover 402 by pulling on the zipper 414 and completely unzipping the pillow sock cover 402, such that the front 401A of the multi-position pillow 401 (shown in FIG. 4B) is opened, and the core support may be easily removed.

The pillow sock cover 402 (including the middle region 405) shown in FIGS. 4A-4B may be manufactured from lyocell fibers (e.g., Tencel™ lyocell fibers), for example, such that the outer surface of the multi-position pillow 401 has a soft and breathable texture. The breathable, soft surface texture of the multi-position pillow 401 may allow the user to experience comfort and relaxation during use, particularly for users prone to sweating due to increasing body temperatures throughout sleep. As mentioned above, the multi-position pillow 401 may be thus configured such that any and all of the interior components (e.g., pillow core support 309) may be removed from the outer pillow sock cover 402. The ability to remove all the interior components of the multi-position pillow 401 may allow cleaning of the sock cover 402 (via a washing machine, for example), such that the sock cover 402 may maintain its cleanliness and freshness, and thus extending the overall use-life of the pillow, as an example. As will be described in greater detail below, the multi-position pillow 401 may further be provided with internal contouring adjustment material for providing increased levels of support, as desired by the user.

Figure 5:
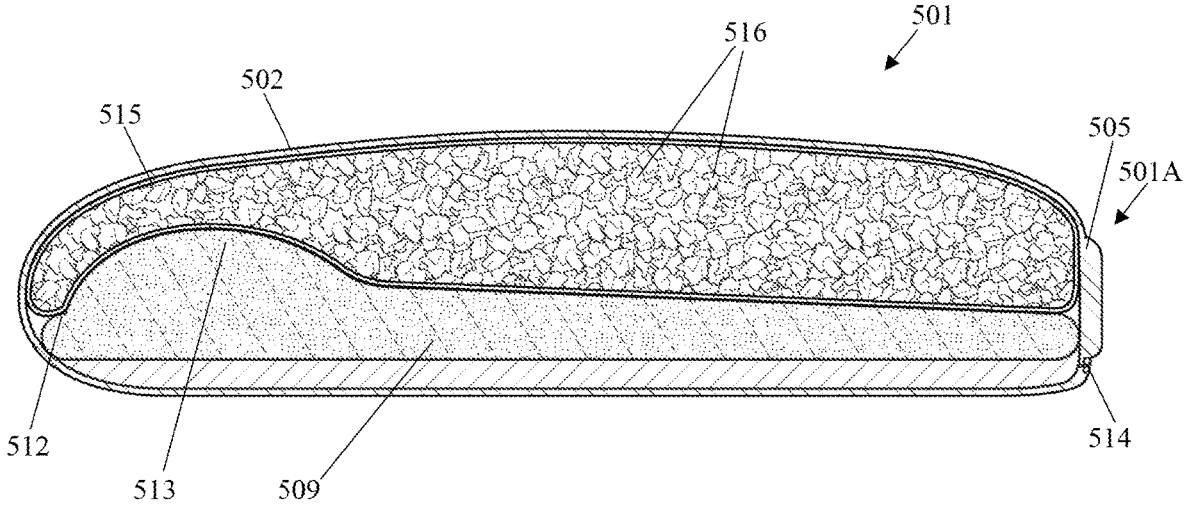
FIG. 5 illustrates a sectional side elevation view of a cervical multi-position pillow having a pillow core support and a contouring adjustment material layer, according to an aspect.

FIG. 5 illustrates a sectional side elevation view of a cervical multi-position pillow 501 having a pillow core support 509 and a contouring adjustment material layer 515, according to an aspect. As mentioned above, the multi-position pillow 501 may be provided with an additional contouring adjustment material layer ("contouring adjustment material layer," "contouring material layer," "loft adjustable material layer," "contouring sleeve") 515 that may be stuffed inside the pillow sock cover 502, such that to line a top surface of the pillow core support 509, as shown. The contouring adjustment material layer 515 may comprise shredded memory foam pieces or fibers 516 that provide additional support within the multi-position pillow 501, for example. The shredded fibers 516, for example, may provide a consistently firm, yet soft, undersurface on which the user may rest. As an example, the contouring adjustment material layer 515 may be provided as a thin, openable sleeve or case adapted to be opened (via a zipper, for example), such that the individual foam pieces 516 may be removed from the sleeve 515, as will be described in greater detail later.

As shown as an example in FIG. 5, the multi-position pillow 501 may comprise the core support 509 and the contouring adjustment material layer 515 disposed within the outer sock cover 502. As shown, the core support 509 may be thus positioned within the outer cover 502, such that the hump 513 is positioned away from the front 501A of the pillow 501, and thus away from the front middle region 505. Such a positioning may allow the softer material of the outer cover 502 and the compressibility of the underlying contouring material layer 515 to more naturally hug the user's neck, such that core support 509 may provide direct support to the user's neck and head, as an example. For example, should the core support 509 be positioned within the pillow 501 with the hump 513 positioned along the front 501A of the pillow, the middle region 505 may hinder the user's ability to fully and comfortably rest their neck onto the hump 513, and/or rest their shoulders onto the bottom recess 512 (as in FIG. 3), which would thus prevent the pillow core support 509 from providing the intended upward cervical support.

The embodiment of the multi-position pillow 501 shown in FIG. 5 may allow the user to comfortably sleep on their back or side, as an example. As described previously, the user may possess a wide variety of sleeping preferences, such as the thickness of the pillow, the firmness of the pillow, and the height or loft at which the user's head is elevated during sleep. Thus, the contouring adjustment material layer 515 and the pillow core support 509 may both be provided inside the pillow sock cover 502 to provide the user with greater cervical support at a higher sleeping elevation or loft. As the user rests on the multi-position pillow 501 (in whichever sleeping position desired), each of the individual foam pieces 516 may softly compress over the shape of the core support 509 surface, as well as the shape of the user's cervical area (i.e., the user's head, neck, and/or shoulder tops). The pillow core support 509 may then provide direct support (e.g., in the manner described previously when referring to FIG. 3 above) to the user's neck, head, and shoulders, such that pressure points therein are alleviated and fuller muscle relaxation is achieved while resting/sleeping at a higher loft. As will be described in greater detail below, the multi-position pillow 501 may alternatively be provided without the core support 509, such that the pillow 501 solely comprises the contouring material layer 515 disposed within the sock cover 502, as an example.

Figure 6:
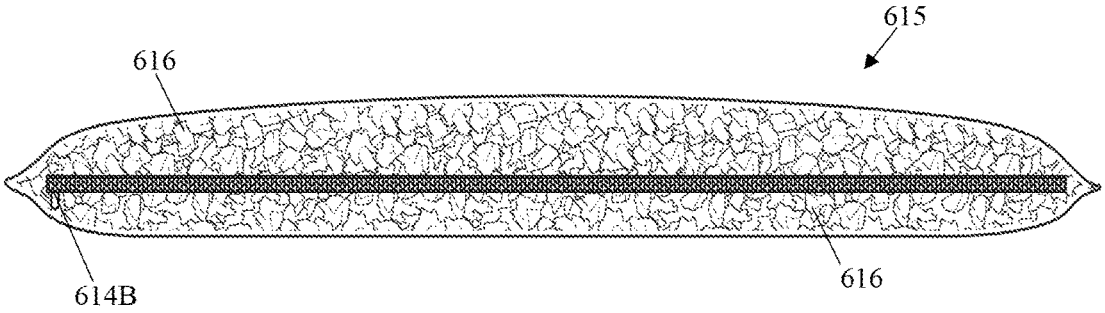
FIG. 6 illustrates a detailed front elevation view of the contouring adjustment material layer of FIG. 5, according to an aspect.

FIG. 6 illustrates a detailed front elevation view of the contouring adjustment material layer 515 of FIG. 5, according to an aspect. As mentioned previously above when referring to FIG. 5, the multi-position pillow (e.g., 501) may be provided with the contouring adjustment material layer 615 that may stuff and/or fill the pillow sock cover (e.g., 502). As disclosed above, the contouring adjustment material layer may be provided as an openable sleeve 615 having a plurality of shredded memory foam pieces 616, which provide additional cervical area support within the multi-position pillow. As shown, the openable sleeve 615 may be provided with a zipper 614B, such that the individual foam pieces 616 may be removed from the sleeve 615, as needed, which will be described in greater detail when referring to FIG. 7. It should be understood that the zipper 614B is depicted slightly larger for clarity.

As an example, the multi-position pillow may be provided with only the contouring adjustment material layer 615 inside the sock cover (e.g., 102) (i.e., without the pillow core support), as previously mentioned above. This embodiment of the multi-position pillow 601 may allow the user to sleep on their stomach with their arm(s) tucked beneath a bottom of the pillow sock cover, for example. While lacking the direct support provided by the pillow core support (e.g., 509 in FIG. 5), the contouring adjustment material layer 615 may continuously provide cervical support to users who prefer to sleep at lower height elevations. As an example, each of the individual memory foam pieces 616 may apply upward pressure on the user while the pillow is in use, while compressing against the shape of the user's head/face, neck, and shoulders, for example. As previously mentioned above when referring to FIG. 5, each of the small, individual contacts applied by each of the foam pieces 616 onto the user's head, neck, and shoulders may altogether evenly alleviate pressures within the cervical area caused by the downward weight of the head, for example. Thus, the multi-position pillow having the contouring material layer 615 may provide the user with soft, low elevation/loft support, as an advantage.

As disclosed previously hereinabove, the cervical multi-position pillow may be positioned such that to be used in a number of different sleeping/resting positions to achieve varying levels of support, depending on the user's preferences and needs. Thus, in accordance with an aspect of the current invention, the cervical multi-position pillow disclosed herein may be provided with four exemplary methods of use. The four methods of use disclosed herein below may accommodate users of varying weight, height and age who may possess cervical soreness and related issues, and who may prefer to sleep in certain positions at varying elevations.

A first method of use for the multi-position pillow may utilize the configuration shown in FIG. 5, as an example. As described above, the multi-position pillow shown in FIG. 5 may comprise an outer pillow sock cover, and an inner pillow core support and a contouring adjustment material layer disposed within the sock cover, as an example. For the first method of use, the user may sleep and/or rest on the multi-position pillow in the position shown in FIG. 3, as an example. Per this method, the user may position their head onto a top of the multi-position pillow, such that the user's neck is comfortably positioned over the hump, as discussed previously when referring to FIG. 3. The user may then proceed to sleep on their back, or may roll onto their side, whichever position is preferred for the user. Thus, an advantage of this first method of use is the additional cervical support due to the added contouring adjustment material layer. Another advantage is the accommodation of a larger user with wider shoulders who would benefit from more support and better weight distribution. An additional advantage is the accommodation of a user who suffers from sinus issues and/or minor reflux issues and who may thus benefit from sleeping elevated at a higher position.

A second method of use for the multi-position pillow may also utilize the configuration shown in FIG. 5, as an example. For the second method of use, the user may sleep and/or rest on the multi-position pillow, such that the user's head and neck are comfortably positioned over the sloped body of the core support, as discussed previously as an example when referring to FIG. 2B. A user may choose to position their head and neck on only the sloped body (e.g., 210 in FIGS. 2A-2B) of the pillow core support because the user may desire cervical area support at a lower elevation than that provided via the first method of use described above, as an example. The user may then proceed to sleep on their back, may roll onto their side, or may sleep face-down on their stomach, whichever position is preferred for the user. Thus, an advantage of the second method of use is the accommodation of back sleepers, side sleepers and/or stomach sleepers who may only want a slight elevation on the pillow. Another advantage is the accommodation of a user who frequently shifts positions during sleep and who may not desire constant direct neck support.

A third method of use for the multi-position pillow may utilize the configuration shown in FIGS. 4A-4B, as an example. As described previously above, the multi-position pillow shown in FIGS. 4A-4B may comprise an outer pillow sock cover and an inner core support, and no contouring adjustment material layer. The third method of use may accommodate users who desire more direct cervical area support while sleeping/resting at a middle elevation level. For the third method of use, the user may unzip the zipper on the front of the multi-position pillow, such that the front of the pillow is opened. The user may then remove the contouring adjustment material layer, such that only the core support remains within the outer sock cover. Next, the user may zip the zipper, such that the front of the pillow is closed, and may proceed to sleep and/or rest on a top of the multi-position pillow in the position shown in FIG. 3, as an example. Per this method, the user may position their head on the multi-position pillow, such that the user's neck is comfortably positioned over the hump, as discussed previously when referring to FIG. 3. The user may then proceed to sleep on their back, or may roll onto their side, whichever position is preferred for the user. Thus, an advantage of this third method of use is the accommodation of back and side sleepers who may prefer a flatter, firmer pillow. Another advantage is the maintained support of the user's cervical area and the distribution of weight from the user's head and neck onto the pillow along the lower elevation.

A fourth method of use for the multi-position pillow disclosed herein may utilize the configuration partially shown in FIG. 6, as an example. As described previously above, the multi-position pillow may comprise an outer pillow sock cover and a contouring adjustment layer disposed within the outer sock cover, and no inner pillow core support. The fourth method of use may accommodate users who desire less direct cervical area support while sleeping/resting at a low elevation level. For the fourth method of use, the user may unzip the zipper on the front of the multi-position pillow, such that the front of the pillow is opened. The user may then remove the inner core support, such that only the contouring adjustment material layer remains inside the outer cover. Next, the user may zip the zipper, such that the front of the pillow is closed, and may proceed to sleep and/or rest on a top surface of the multi-position pillow, as an example. Per this method, cervical area support is provided entirely by the memory foam pieces or fibers that make up the contouring adjustment material layer. The user may then proceed to sleep on their back, may roll onto their side, or may sleep face-down on their stomach, whichever position is preferred for the user. Thus, an advantage of the fourth method of use is the accommodation of stomach sleepers who may desire the ability to tuck their arms under the pillow. Another advantage is that the pillow may not flatten or bottom out completely while the user rests on top of the pillow, which provides the user with a soft, compressing surface support.

Figure 7:
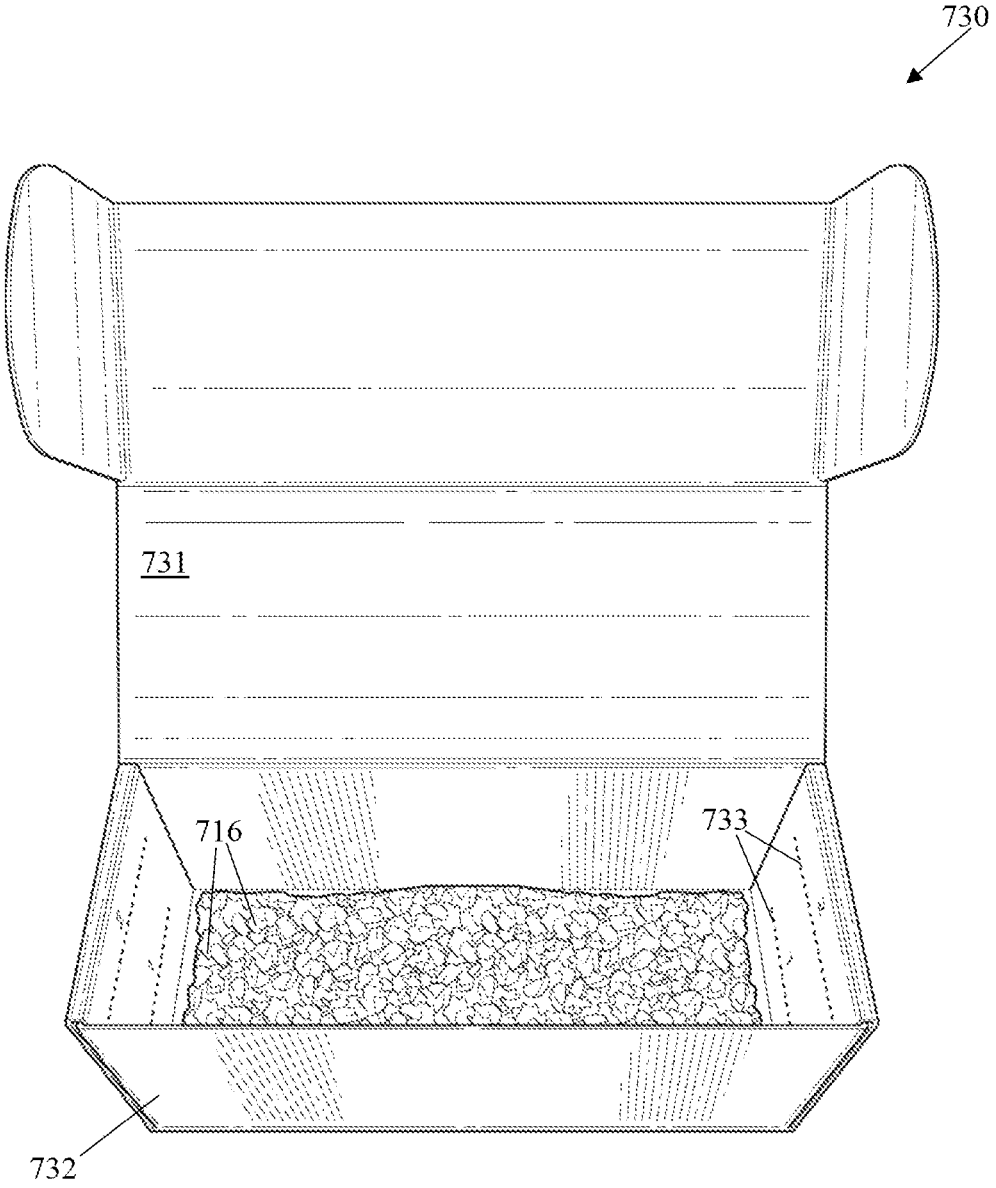
FIG. 7 illustrates a front perspective view of an exemplary packaging container for the cervical multi-position pillow, according to an aspect.

FIG. 7 illustrates a front perspective view of an exemplary packaging container 730 for the cervical multi-position pillow (e.g., 101 in FIG. 1), according to an aspect. As an example, the multi-position pillow disclosed throughout this disclosure above may be removably associated with the exemplary packaging ("packaging," "package," "packaging container") 730 shown in FIG. 7. As shown, the packaging 730 may be rectangular in shape, and may comprise a central container portion 732 and a top lid portion 731 for sealing closed the packaging 730. As an example, the packaging 730 may serve multiple functions, rather than the single function of simply housing the multi-position pillow described above. The packaging 730 may also function as a measuring tool and as a container for excess pillow material, as will be described in detail below.

As mentioned previously above when referring to FIGS. 5 and 6, the cervical multi-position pillow may be provided with a removable contouring adjustment material layer for providing additional cervical support and comfort within the pillow. As described above, the height or elevation and firmness of the multi-position pillow may thus be adjustable by removing specific amounts of the foam pieces (or alternatively adding specific amounts of said foam pieces) within the contouring adjustment material layer, as an example. However, removing or adding random/arbitrary amounts of said memory foam pieces from the contouring adjustment layer within the pillow may be inefficient, and may thus result in an inconsistency in the amount of contouring adjustment material within the pillow. Such inconsistency within the pillow may thus give rise to issues of discomfort and/or lack of cervical support during use, as an example. To avoid such potential issues, the packaging container 730 may thus be configured to be used as a measuring tool, such that the amount of shredded foam pieces removed from the contouring adjustment material layer within the multi-position pillow is appropriately portioned, which will be described in detail below.

As an example, the multi-position pillow may comprise a known interior volume (e.g., determined by the size of the pillow sock cover) and may thus initially be provided with a contouring material layer having a known, preselected amount of shredded memory foam pieces 716. Knowing the preselected amount (i.e., weight or volume) of shredded foam pieces 716 within the pillow, such as, for example, 3-4 pounds, as well as the relative weight of each foam piece 716, and knowing a volume of the container portion 732, specific relative volumetric increments can be calculated, such that the shredded foam pieces 716 may be removed from the contouring material layer in a guided manner. As shown in FIG. 7, interior walls of the container portion 732 of the packaging 730 may be provided with increments or reference lines 733 (e.g., as in a measuring cup) indicating the calculated volumetric increments of the shredded foam pieces 716 recommended to be removed from or added to the contouring material layer for maintaining consistent height and firmness throughout the pillow. As an example, let each increment 733 correlate to 0.25 pounds worth of the shredded foam pieces 716. As such, each increment correlates to an increase of 0.25 pounds of foam pieces 716 when added into the multi-position pillow, and vice versa, to a decrease of 0.25 pounds of foam pieces 716 when removed from the multi-position pillow. Thus, each increment 733 may represent a size/height level of the multi-position pillow, the size/height level thus being adjustable by the addition or removal of the shredded foam pieces 716.

As an example, a user having a particular body type and sleeping preference, may require adjustment of the height or loft of the multi-position pillow, such that the elevation that the user sleeps/rests at may be adjusted. The multi-position pillow may be providing the cervical area support at too high or too low of an elevation during use, for example. As such, utilizing the packaging container 730 in the manner outlined above, the user may add or remove pieces of the shredded foam 716 into or out from the contouring material layer within the pillow, as needed. As an example, let the user desire a decrease in the height/size of the multi-position pillow during use, and particularly a decrease by one height level (one increment 733). As described above, the user may thus open the multi-position pillow via the zipper and remove the contouring adjustment material layer. The user may then open the contouring adjustment layer/sleeve and remove the foam pieces from the sleeve and place the foam pieces 716 into the container portion 732 of the packaging 730, as shown. The user may continuously fill the container 732 with the foam pieces 716 until a total amount of the foam pieces 716 within the container portion 732 reaches the first increment line 733 (e.g., line "1" as shown in FIG. 7). The user may then zip closed the contouring sleeve and place the sleeve back into the multi-position pillow, such that the height of the multi-position pillow has now decreased by one level, per the example.

It should be understood that, should the decrease in height for the multi-position pillow by one level be too much, per the example above, the user can add in a portion (e.g., half) of the removed foam pieces 716 back into the contouring material layer. The user may continue to add and foam pieces 716 to the contouring material layer until the optimal height level is achieved for the user, as an example. It should be understood that, reversibly, should the decrease in height for the multi-position pillow by one level be too little, per the example above, the user can remove additional portions of the shredded foam pieces (up to line "2") to achieve the desired height level, as an example.

The contouring adjustment material 716 that has been removed from the multi-position pillow may thus be safely contained and stored within the packaging 730, allowing the user to place the contouring adjustment material back into the pillow at a later date, if desired. Thus, an advantage is that the user may remove the contouring adjustment material such that to adjust the height and firmness of the multi-position pillow in an easy, guided, and reliable manner. Another advantage is that the surface texture of the multi-position pillow may be kept consistent after user removal of the contouring adjustment material. It should be understood that, alternatively, the height of the multi-position pillow may be increased by one or more levels by adding additional contouring foam pieces to the contouring sleeve using the increments 733 in the manner described above. The multi-position pillow may be provided with "extra" shredded foam pieces within the packaging container 730 for this purpose. As described previously above when referring to FIG. 6, the multi-position pillow may be thus adapted such that the multi-position pillow may be used by a user without the core support (e.g., 209 in FIGS. 2A-2B). The user may remove the pillow core support and securely store it within the packaging 730 as well, allowing the user to optionally place the pillow core support back into the pillow at a later date, if desired.

It should be noted that additional methods of use for the cervical multi-position pillow may exist and that the methods disclosed herein above are not limiting, and merely serve as examples of possible methods of use. It should be understood that the placement of the increment lines within the packaging shown in FIG. 7 is exemplary and therefore not limiting, and that the placement is relative to the size of the pillow, which is subject to change, as described above. It should also be understood that, while the multi-position pillow, including the outer sock cover, the inner core support, and the contouring material layer, is depicted as having generally rectangular outer shape, the multi-position pillow and its exemplary components may alternatively be provided as having other outer shapes, such as circular, or elliptical, for example. It should also be understood that the outer cover and the contouring adjustment layer may each be provided with alternative fastening means than a zipper, such as, for example, buttons, Velcro®, magnets, laces, etc. It should also be understood that the multi-position pillow may be provided with additional sheets of fabric or foam, for example, disposed within the other cover (beneath the core support, for example) for providing additional support and/or loft.

Figure 8A:
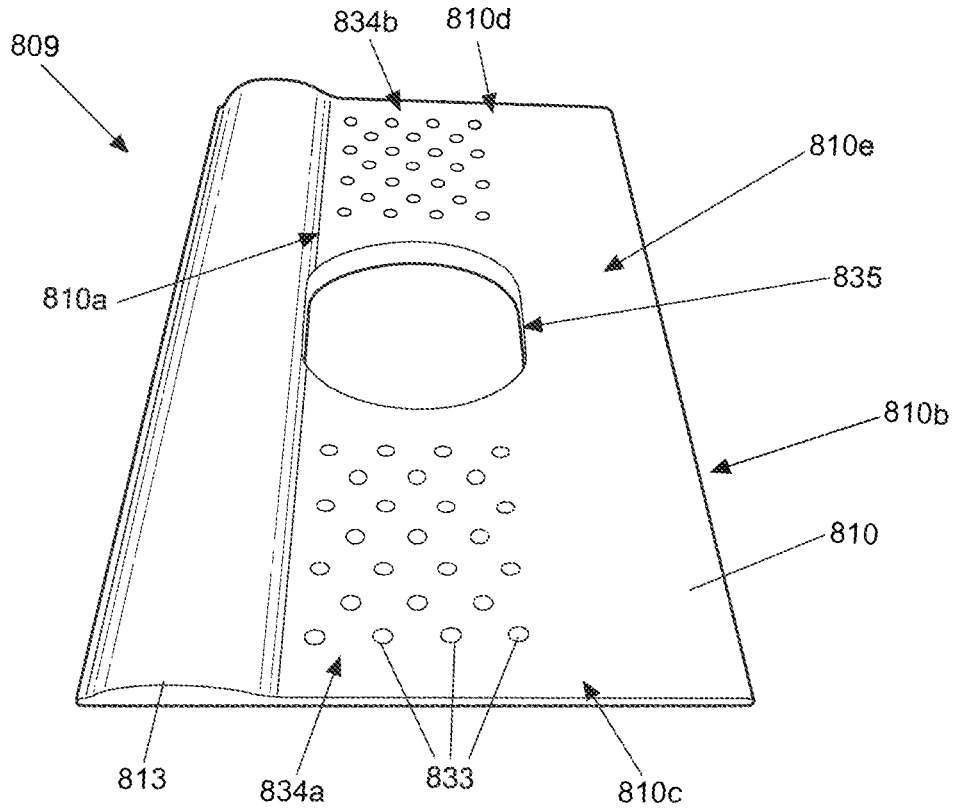
FIG. 8A illustrates a top perspective view of an example of a pillow core support having a plurality of venting through holes and a contour hole, according to an aspect.
Figure 8B:
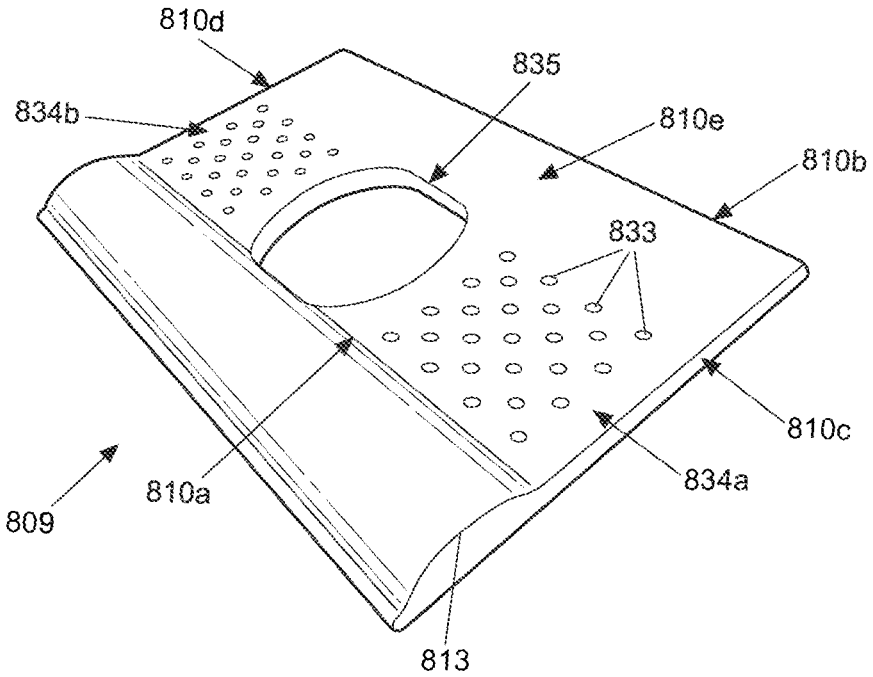
FIG. 8B illustrates a side perspective view of an example of a pillow core support having a plurality of venting through holes and a contour hole, according to an aspect.

FIG. 8A illustrates a top perspective view of an example of a pillow core support 809 having a plurality of venting through holes 833 and a contour hole 835, according to an aspect. FIG. 8B illustrates a side perspective view of an example of a pillow core support 809 having a plurality of venting through holes 833 and a contour hole 835, according to an aspect. The disclosed pillow core support 809, 909 of FIG. 8A—FIG. 9 may exhibit similar physical characteristics to the prior disclosed pillow support cores described hereinabove, with the exception of the addition of a plurality of venting through holes ("venting holes", "vent holes") 833 and a contour hole 835. The provided venting holes 833 and the contour hole 835 may provide functions corresponding to enhanced cooling capabilities and increased contouring capabilities, as will be described in greater detail hereinbelow.

Figure 9:
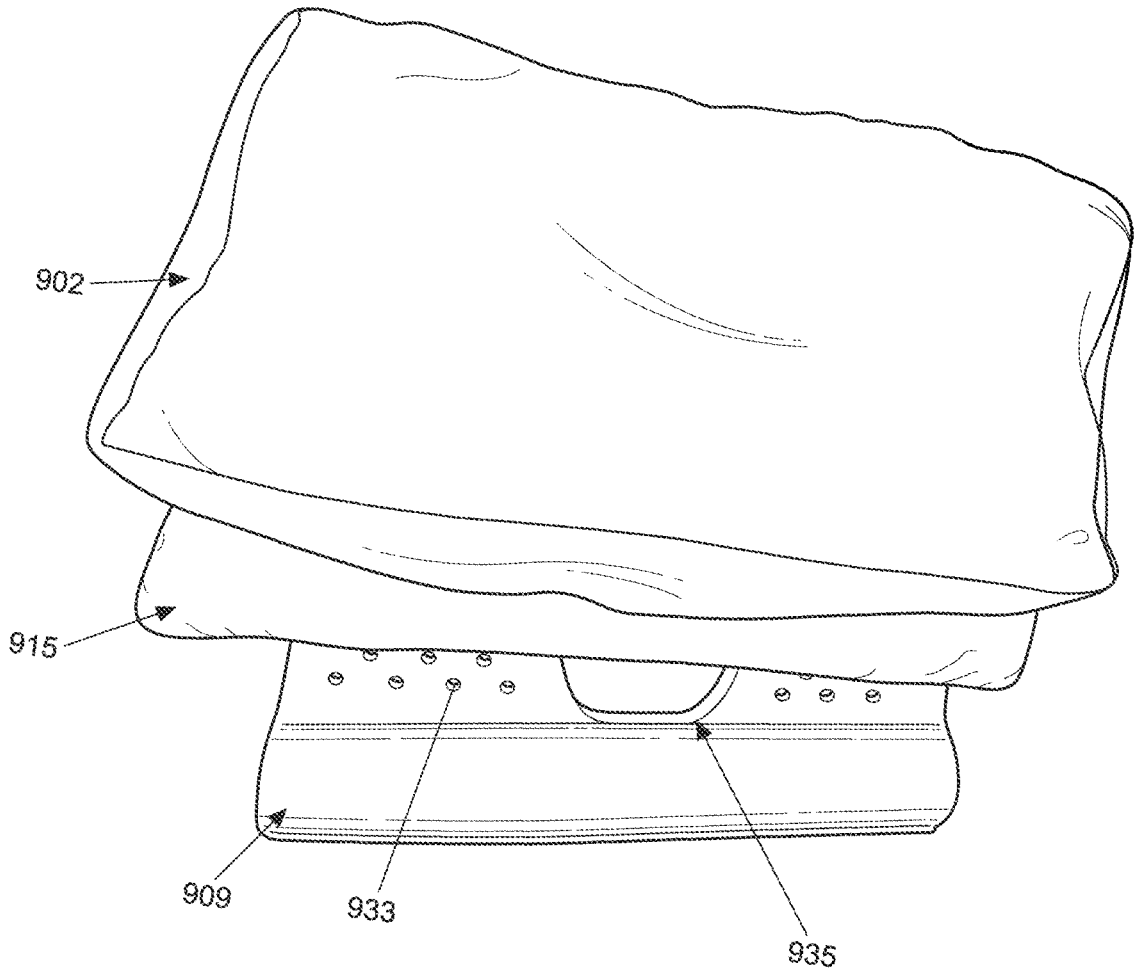
FIG. 9 illustrates a top perspective view of an outer pillow sock, contouring adjustment material layer and inner pillow core support, according to an aspect.

The venting holes 833 may be disposed within ramp 810 of a pillow support core 809 as depicted in FIG. 8A-FIG. 9, such that they travel completely through said ramp 810 of the pillow core support 809, or may alternatively be positioned elsewhere on the pillow core support 809, so long as said venting holes 833 do not negatively impact the structural integrity of said pillow support core 809. Said venting holes 833 may run through the pillow support core 809, to both increase the surface area of the pillow core support 809 and allow air to travel through said pillow support core 809, both of which may help pillow core support 809, and thus the surrounding multi-position pillow, be more breathable and release stored heat more effectively. The venting holes 833 may be arranged into one or more equidistant grid patterns, such as the grid patterns 834*a*, 834*b* depicted in FIG. 8A-FIG. 9, such that each venting hole 833 is separated from each neighboring venting hole 833 by the same distance. This pattern may allow for an optimal quantity of venting holes 833 to be distributed throughout the pillow support core 809 without negatively impacting said pillow support core's structural integrity. Two separate grids of venting holes 834*a*, 834*b* may be positioned on the pillow support core 809 such that the aforementioned contour hole 835 is disposed between the two grids of venting holes 834*a*, 834*b*. Each grid of venting holes 834*a*, 834*b* may be disposed on a different lateral side, 810*c*, 810*d* of the ramp 810, such that a first grid of venting holes 834*a* is disposed on a first lateral side 810*c* and a second grid of venting holes 834*b* is disposed on a second lateral side 810*d*. A center portion of the slope 810*e* may be disposed between the first lateral side 810*c* and the second lateral side 810*d* of the slope.

These described venting holes may allow the associated pillow core support 809 to vent heat more effectively as a result of said venting holes increasing the surface area of their associated pillow core support. In conjunction with the use of a breathable pillow cover and a breathable contouring adjustment material layer, as applicable, such as those described hereinabove, the described venting holes 833 may also allow the disclosed multi-position pillow to release heat more efficiently by allowing air to travel through the multi-position pillow more easily. Such an adaptation may be important for individuals that produce more heat while they are sleeping, are more susceptible to having their rest interrupted by their pillow becoming too warm, or otherwise require their pillow to maintain a lower temperature while they sleep to ensure that they do not have their rest disrupted.

While the structural integrity of the pillow core support 809 may not be compromised by the presence of a plurality of venting holes 833, the contour of the pillow core support 809 may be altered by its presence. The presence of a multiple venting holes 833 within a certain proximity of each other may increase the flexibility of corresponding portions of the pillow core support 809, thus increasing its ability to conform to the contours of a user's head. While the contour of the pillow support core 809 may not be as significantly affected by the presence of these venting holes 833 as it is by the presence of the contour hole 835, said venting holes 833 may provide a more subtle increase to the pillow conformational capabilities, while still providing a firmer support that may be desired by certain users. This increase in pillow flexibility may also make the pillow softer for users in corresponding regions of the pillow, which may be desirable for obtaining a more comfortable fit during use, and thus a superior resting experience. The described venting through holes 833 may provide height and support for the user's head, while also ensuring greater comfort for certain parts of the head, such as the ears, especially when users are sleeping on their side.

The described contour hole 835 may be positioned on the ramp 810 of the pillow support core 809, such that it is on a center portion 810*e* of the ramp 810 positioned between the two lateral sides 810*c*, 810*d*. This described positioning of the contour hole 835 may be consistent with the positioning of a user's head during use, such as when the user laying on their back as depicted in FIG. 3, or when the user is lying on their side, as described hereinabove. Much like the aforementioned venting through holes 833, the contour hole 835 may be provided as a through hole that travels completely through the ramp 810 of the pillow support core 809, which may increase the breathability of the multi-position pillow, allowing heat on the surface of a user's head to dissipate more rapidly during use. When a pillow support core 809 having a contour hole 835 is used in a multi-position pillow, alongside a contouring adjustment material layer, such as contouring adjustment material layer 915 of FIG. 9, the contour hole 835 may provide a suitably contoured structure for the contouring material layer 915 to lay over, in order to achieve an improved contour for supporting a user having an oval shaped head, for example. For example, the contour hole 835 may have roughly an oval shape with an approximate diameter of 7 inches, as depicted in FIG. 8A-9, which may be configured to provide a more tailored fit for individuals with a more oval shaped head, without compromising support or comfort for users with other head shapes. The contour of the cervical multi-position pillow may be modified solely by adjusting the contouring adjustment material layer, while keeping the dimensions of the contour hole 835 constant, such that one style or size of pillow core support 809 may be provided with varying sizes of contouring adjustment material layers (or an adjustable contouring adjustment material layer, as disclosed hereinabove) to conform to the head shapes/sleep styles of different users. As mentioned hereinabove, the contour hole 835 may be a through hole and travels completely though the slope 810 as depicted in FIG. 8A-9, or alternatively may not travel fully through the slope 810, as will be described in greater detail hereinbelow.

It should be understood that variations on the arrangements and configurations of the disclosed vent holes 833 and the contour hole 835 may be implemented without deviating from the scope of the disclosed cervical multi-position pillow. For example, the disclosed pillow core support 809 may have a contour hole that is not a through hole, such that it does not travel completely though the ramp 810 on which it is disposed, thus creating a nested pocket in which a user may seat their head during use. Such a contour hole in said example may have a bottom surface that is coplanar with a bottom surface of the ramp 810. Much like contour hole 835 of FIG. 8A-8B, the contour hole of the presently described example may provide enhanced contouring capabilities to the pillow support core 809 by providing a seating pocket that conforms to the contours of the user's head. Said contour hole of the presently described example may be further modified to include one or more venting through holes through the bottom surface of said contour hole, such that venting within said contour hole may still be facilitated, as necessary. Other variations to the positioning and sizes of the disclosed vent holes 833 and the contour hole 835 may be implemented as necessary depending on the needs of the application and the preference of the user.

It should also be understood that while the contour hole 835 is configured to provide an improved fit, and thus better support and comfort, to individuals having a particular shape of head, said contour hole 835 does not take away from the comfort and support of those having different head shapes and may be used by all types of sleepers (side, back, etc.). The improved conformational fit for individuals having a more oval shaped head simply allows for the pillow to comfortably accommodate more body/head types without taking away support for individuals with flatter or rounder heads. The disclosed contouring adjustment material layer, such as contouring adjustment material layer 915, may provide a shredded foam material over the surface of the contour hole 835 to support and conform to each user's head shape needs, regardless of the specific shape of their head. This conformational adaptivity of the disclosed multi-position pillow provides comfort and support to users regardless of their head shape or their preferred sleep position, allowing said pillow to be effectively utilized by all types of sleepers.

FIG. 9 illustrates a top perspective view of an outer pillow sock 902, a contouring adjustment material layer 915 and a pillow core support 909, according to an aspect. As described hereinabove, a cervical multi-position pillow, such as cervical multi-position pillow 101, may be comprised of a contouring adjustment material layer 915 supported by a subjacent pillow core support 909, both of which are enclosed within a pillow sock 902. The usage of a pillow core support 909 having a contour hole 935 provides a central contour on the ramp supported portion of the multi-position pillow, which may be adapted to conform to the contours of a user's head and may provide a comfortable and form fitting position for said user's head to rest, particularly when used in conjunction with the disclosed contouring adjustment material layer. This contour hole 935 may be utilized by side sleepers, back sleepers and every other type of sleeper, as a result of its central positioning on the ramp of the pillow core support 909. This contour hole 935 may also help allow the cervical multi-position pillow release stored heat faster and remain at a lower temperature as a result the capability of air the travel through said contour hole 935.

The disclosed vent holes 933 on the ramp of the pillow core support 909 may also help the cervical multi-position pillow remain colder by both increasing said pillow core's surface area and allowing air to travel through it. However, unlike the contour hole 935, said vent holes 933 may not impact the contour of the pillow as significantly. In some instances, such as when the user is a side sleeper who prefers to lay flatter, a user may not wish to utilize the contour provided by the centrally positioned contour hole 935. In said instances, the user may utilize the portions of the cervical multi-position pillow supported by lateral sides 810*c*, 810*d* of the ramp 810. Said lateral sides do not have their contour affected as drastically by the vent holes 933 and thus the slope of the pillow may provide a lesser degree of head conformation on these lateral sides. As described hereinabove, these vent holes 933 may be arranged in grid patterns on opposite lateral sides 810*c*, 810*d* of the pillow core support 909, such that the centrally positioned contour hole 935 is disposed between the two grids of vent holes 933. The utilization of a plurality of vent holes 933 with a centrally positioned contour hole 935 on the pillow core support 909 allows said pillow core support 909, and thus the multi-position pillow it is incorporated within, to remain cooler, while simultaneously facilitating different contour options depending on how it is utilized. A user that wishes to utilize the increased contour of the contour hole 935 must simply center their head on the pillow, whereas users who do not wish to utilize the contour hole 935 may simply laterally offset their position on the pillow to avoid it.

The presence of a contour hole 935 on the pillow core support 909 provides users with additional contour options to better conform to their preferences and thus may help improve the quality of their rest. Additionally, both the vent holes 933 and contour hole 935 may help keep the pillow at a lower temperature during use, which may also help improve the quality of a user's rest, particularly with user who would previously become too warm when sleeping. The ability of the disclosed pillow support core 909 having vent holes 933 and a contour hole 935 to better conform to the shape/contours of a user's head further allows for better neck alignment, as well as increased height and support for users, allowing the disclosed pillow to support individuals with different sleep styles and head shapes.

It may be advantageous to set forth definitions of certain words and phrases used in this patent document. The term "couple" and its derivatives refer to any direct or indirect communication between two or more elements, whether or not those elements are in physical contact with one another. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Further, as used in this application, "plurality" means two or more. A "set" of items may include one or more of such items. Whether in the written description or the claims, the terms "comprising," "including," "carrying," "having," "containing," "involving," and the like are to be understood to be open-ended, i.e., to mean including but not limited to. Only the transitional phrases "consisting of" and "consisting essentially of," respectively, are closed or semi-closed transitional phrases with respect to claims.

As used throughout this disclosure, the meaning of the term "loft" is synonymous with the meanings of the terms "height" and/or "elevation" with reference to the pillow. Particularly, these terms refer to the height and/or angle at which the user's head or face is raised from surface of the bed or other surface, for example. It should be understood that the term "zipper," as used herein and as shown throughout the drawings, includes the slider and the chain by which any zipper functions.

If present, use of ordinal terms such as "first," "second," "third," etc., in the claims to modify a claim element does not by itself connote any priority, precedence or order of one claim element over another or the temporal order in which acts of a method are performed. These terms are used merely as labels to distinguish one claim element having a certain name from another element having a same name (but for use of the ordinal term) to distinguish the claim elements. As used in this application, "and/or" means that the listed items are alternatives, but the alternatives also include any combination of the listed items.

Throughout this description, the aspects, embodiments or examples shown should be considered as exemplars, rather than limitations on the apparatus or procedures disclosed or claimed. Although some of the examples may involve specific combinations of method acts or system elements, it should be understood that those acts and those elements may be combined in other ways to accomplish the same objectives.

Acts, elements and features discussed only in connection with one aspect, embodiment or example are not intended to be excluded from a similar role(s) in other aspects, embodiments or examples.

Aspects, embodiments or examples of the invention may be described as processes, which are usually depicted using a flowchart, a flow diagram, a structure diagram, or a block diagram. Although a flowchart may depict the operations as a sequential process, many of the operations can be performed in parallel or concurrently. In addition, the order of the operations may be re-arranged. With regard to flowcharts, it should be understood that additional and fewer steps may be taken, and the steps as shown may be combined or further refined to achieve the described methods.

If means-plus-function limitations are recited in the claims, the means are not intended to be limited to the means disclosed in this application for performing the recited function, but are intended to cover in scope any equivalent means, known now or later developed, for performing the recited function.

Claim limitations should be construed as means-plus-function limitations only if the claim recites the term "means" in association with a recited function.

If any presented, the claims directed to a method and/or process should not be limited to the performance of their steps in the order written, and one skilled in the art can readily appreciate that the sequences may be varied and still remain within the spirit and scope of the present invention.

Although aspects, embodiments and/or examples have been illustrated and described herein, someone of ordinary skills in the art will easily detect alternate of the same and/or equivalent variations, which may be capable of achieving the same results, and which may be substituted for the aspects, embodiments and/or examples illustrated and described herein, without departing from the scope of the invention. Therefore, the scope of this application is intended to cover such alternate aspects, embodiments and/or examples. Hence, the scope of the invention is defined by the accompanying claims and their equivalents. Further, each and every claim is incorporated as further disclosure into the specification.

What is claimed is:

1. A multi-position pillow for providing cervical area support and decompression during sleep, the multi-position pillow comprising:

an outer cover adapted to be selectively opened;

a core support removably associated with the outer cover, the core support comprising:

a sloped body having a first end, a second end, and a center portion disposed between the first end and the second end, wherein a downward slope of the sloped body extends from the first end to the second end;

a plurality of venting through holes in the sloped body the plurality of venting through holes being arranged into two separate grid patterns each comprising an equidistant grid pattern, the two separate grid patterns comprising a first grid pattern disposed on a first lateral side of the sloped body, and a second grid pattern disposed on a second lateral side of the sloped body, wherein the equidistant grid pattern is a pattern such that each hole of the first grid pattern is separated from each neighboring venting hole of the first grid pattern by the same distance, and each hole of the second grid pattern is separated from each neighboring venting hole of the second grid pattern by the same distance;

a contour hole on the center portion of the sloped body, disposed between the first grid pattern and the second grid pattern, the contour hole having a first contour hole end oriented towards the first end of the sloped body and a second contour hole end oriented towards the second end of the sloped body;

wherein the plurality of venting through holes extends from the first contour hold end to the second contour hole end, such that the sloped body does not have venting through holes in an area extending from the second end of the sloped body to the second contour hole end;

a head connected to the first end, the head comprising a hump; and a first recess disposed along a top end of the hump, the first recess forming a rounded ledge at an end of the head;

wherein the plurality of venting through holes and the contour hole are configured to improve pillow ventilation by allowing air to travel through the core support; and a contouring material layer being removably associated with the outer cover, the contouring material layer being compressed over a top surface of the core support when disposed within the outer cover;

wherein the compression of the contouring material layer over a top surface of the core support allows the contouring material layer to lay over the contour hole to achieve an improved contour for supporting a user's head; and wherein, thereby, when a user is positioned atop the contouring material layer and the core support during sleep, such that user's neck rests on the hump, cervical area support is provided, and further a tension force is induced on the user's neck, the tension force causing a decompression of the neck and thus, resulting in a relief of pressure in the cervical area.

2. The multi-position pillow of claim 1, further comprising a zipper disposed along a front of the outer cover, the zipper being adapted to zip the outer cover opened and closed.

3. The multi-position pillow of claim 2, wherein the outer cover further comprises a middle region disposed centrally and horizontally along a front and sides of the outer cover, a front portion of the middle region containing at least a portion of the zipper.

4. The multi-position pillow of claim 3, wherein, when the core support is associated with the outer cover and the contouring material layer, the hump of the core support is positioned along a rear of the outer cover, such that the hump is positioned away from the front portion of the middle region.

5. The multi-position pillow of claim 1, wherein the core support further comprises a second recess disposed in the head along a bottom end of the hump, the second recess having a second height, the second height being shorter than a first height of the first recess.

6. The multi-position pillow of claim 1, wherein the contouring material layer is a sleeve comprising shredded memory foam pieces.

7. The multi-position pillow of claim 6, wherein the sleeve further comprises a zipper, such that a portion of the shredded memory foam pieces can be selectively removed from the sleeve when the zipper is unzipped for selecting a sleeping elevation.

8. A multi-position pillow for providing cervical area support and decompression during sleep, the multi-position pillow comprising:

an outer cover adapted to be selectively opened; and a core support removably associated with the outer cover, the core support comprising:

a sloped body having a first end, a second end, and a center portion disposed between the first end and the second end, wherein a downward slope of the sloped body extends from the first end to the second end, the sloped body being adapted to selectively receive and provide support for a user's neck and head;

a plurality of venting through holes in the sloped body, the plurality of venting through holes being arranged into two separate grid patterns each comprising an equidistant grid pattern, the two separate grid patterns comprising a first grid pattern disposed on a first lateral side of the sloped body, and a second grid pattern disposed on a second lateral side of the sloped body, wherein the equidistant grid pattern is a pattern such that each hole of the first grid pattern is separated from each neighboring venting hole of the first grid pattern by the same distance, and each hole of the second grid pattern is separated from each neighboring venting hole of the second grid pattern by the same distance;

a contour hole on the center portion of the sloped body, disposed between the first grid pattern and the second grid pattern, the contour hole having a first contour hole end oriented towards the first end of the sloped body and a second contour hole end oriented towards the second end of the sloped body;

wherein the plurality of venting through holes extends from the first contour hold end to the second contour hole end, such that the sloped body does not have venting through holes in an area extending from the second end of the sloped body to the second contour hole end;

a head connected to the first end, the head comprising a hump; and a first recess disposed along a top end of the hump, the first recess forming a rounded ledge at an end of the head;

wherein the plurality of venting through holes is configured to improve pillow ventilation by allowing air to travel through the core support; and wherein the contour hole is configured to allow the core support to conform to the contours of user's head while allowing air to travel through the core support to further improve pillow ventilation;

wherein the core support is configured to provide cervical area support to a user during sleep.

9. The multi-position pillow of claim 8, wherein the outer cover further comprises a middle region disposed centrally and horizontally along a front and sides of the outer cover.

10. The multi-position pillow of claim 9, wherein, when the core support is associated with the outer cover, the hump of the core support is positioned along a rear of the outer cover, such that the hump is positioned away from a portion of the middle region disposed along the front of the outer cover.

11. The multi-position pillow of claim 8, wherein the plurality of venting through holes is configured to increase the flexibility of the core support and allow said core support to contour to the shape of a user's head.

12. The multi-position pillow of claim 8, wherein the core support further comprises a second recess disposed in the head along a bottom end of the hump, the second recess having a second height, the second height being shorter than a first height of the first recess.

13. A method of obtaining cervical area support and decompression using a multi-position pillow, the method comprising the steps of:

receiving the multi-position pillow, the multi-position pillow comprising:

an outer cover adapted to be selectively opened; and a core support removably associated with the outer cover, the core support comprising:

a sloped body having a first end, a second end, and a center portion disposed between the first end and the second end, wherein a downward slope of the sloped body extends from the first end to the second end, the sloped body being adapted to selectively receive and provide support for a user's neck and head;

a plurality of venting through holes in the sloped body, the plurality of venting through holes being arranged into two separate grid patterns each comprising an equidistant grid pattern, the two separate grid patterns comprising a first grid pattern disposed on a first lateral side of the sloped body, and a second grid pattern disposed on a second lateral side of the sloped body, wherein the equidistant grid pattern is a pattern such that each hole of the first grid pattern is separated from each neighboring venting hole of the first grid pattern by the same distance, and each hole of the second grid pattern is separated from each neighboring venting hole of the second grid pattern by the same distance;

a contour hole on the center portion of the sloped body, disposed between the first grid pattern and the second grid pattern, the contour hole having a first contour hole end oriented towards the first end of the sloped body and a second contour hole end oriented towards the second end of the sloped body;

wherein the plurality of venting through holes extends from the first contour hold end to the second contour hole end, such that the sloped body does not have venting through holes in an area extending from the second end of the sloped body to the second contour hole end;

a head connected to the first end, the head comprising a hump, the hump being adapted to selectively receive and provide support for a user's head; and a recess disposed along a top end of the hump, the recess forming a rounded ledge at an end of the head;

placing the multi-position pillow onto a surface, such that a face of the hump of the pillow core support is oriented to face up; and laying on a top of the multi-position pillow, such that to obtain cervical area support, the multi-position pillow providing the cervical area support at a user-selected sleeping elevation.

14. The method of claim 13, wherein the multi-position pillow further comprises:

a contouring material layer removably associated with the outer cover, the contouring material layer comprising:

a zipper for selectively opening the contouring material layer; and shredded memory foam pieces, the shredded memory foam pieces being compressible such that to compress over a top surface of the core support when disposed within the outer cover;

wherein an association of the contouring material layer with the outer cover causes the contouring material layer to be positioned atop the core support within the outer cover.

15. The method of claim 13, wherein the laying on a top of the multi-position pillow, such that to obtain the cervical area support, is performed by:

orienting the multi-position pillow on the surface, such that the hump is positioned on a near end of the multi-position pillow; and laying on the top of the multi-position pillow, such that the shoulder tops are positioned on the rounded ledge, the neck is positioned on the face of the hump, and the head is positioned on the first end of the sloped body.

16. The method of claim 14, wherein the laying on a top of the multi-position pillow, such that to obtain the cervical area support, is performed by:

orienting the multi-position pillow on the surface, such that the hump is positioned on a far end of the multi-position pillow; and laying on the top of the multi-position pillow, such that the contouring material layer is caused to compress over the top surface of the core support, and such that at least a portion of the neck and the head are positioned on the sloped body.

17. The method of claim 14, wherein the laying on a top of the multi-position pillow, such that to obtain the cervical area support, is performed by:

orienting the multi-position pillow on the surface, such that the hump is positioned on a near end of the multi-position pillow; and laying on the top of the multi-position pillow, such that the contouring material layer is caused to compress over the top surface of the core support, such that at least a portion of the shoulder tops are positioned on the rounded ledge, at least a portion of the neck is positioned on the face of the hump, and at least a portion of the head is positioned on the first end of the sloped body.

18. The method of claim 14, further comprising:

receiving a packaging container, the multi-position pillow being removably associated with the packaging container, the packaging container comprising increment lines disposed on an interior wall of the packaging container;

if the sleeping elevation of the provided cervical area support is too high:

opening the multi-position pillow, and removing the contouring material layer from the multi-position pillow;

opening the contouring material layer via the zipper, such that to expose the shredded memory foam pieces for removing the shredded memory foam pieces; and removing a portion of the shredded memory foam pieces and placing the portion of the shredded memory foam pieces into the packaging container until an amount of the shredded memory foam pieces placed within the packaging container reaches one of the increment lines;

if the sleeping elevation of the provided cervical area support is too low:

opening the multi-position pillow, and removing the contouring material layer from the multi-position pillow;

opening the contouring material layer via the zipper, such that to expose the shredded memory foam pieces for adding additional shredded memory foam pieces;

placing a portion of the additional shredded memory foam pieces into the packaging container until an amount of the portion of the additional shredded memory foam pieces placed within the packaging container reaches one of the increment lines; and adding the amount of the portion of the additional shredded memory foam pieces to the contouring material layer;

closing the contouring material layer via the zipper and placing the contouring material layer back into the multi-position pillow; and closing the multi-position pillow and laying on the top of the multi-position pillow.

* * * * *